US011859146B1

(12) United States Patent
Bataille Morin et al.

(10) Patent No.: US 11,859,146 B1
(45) Date of Patent: Jan. 2, 2024

(54) AMMONIA-BASED FUEL FOR COMPRESSION ENGINES CONTAINING A COMBUSTION ENHANCEMENT ADDITIVE

(71) Applicant: VERYONE, Sorgues (FR)

(72) Inventors: Anne-Gaëlle Bataille Morin, Bures sur Yvette (FR); Richard Samson, Saran (FR); Fabrice Foucher, Saint Jean le Blanc (FR)

(73) Assignee: VERYONE, Sorgues (FR)

( * ) Notice: Subject to any disclaimer, the term of this patent is extended or adjusted under 35 U.S.C. 154(b) by 0 days.

(21) Appl. No.: 17/953,708

(22) Filed: Sep. 27, 2022

(30) Foreign Application Priority Data

Jun. 23, 2022 (FR) ..... 2206261

(51) Int. Cl.
*C10L 10/12* (2006.01)
*C10L 1/23* (2006.01)

(52) U.S. Cl.
CPC ..... *C10L 1/231* (2013.01); *C10L 10/12* (2013.01); *C10L 2200/0259* (2013.01); *C10L 2230/22* (2013.01); *C10L 2270/026* (2013.01); *C10L 2290/24* (2013.01)

(58) Field of Classification Search
CPC .. C10L 1/231; C10L 10/12; C10L 2200/0259; C10L 2230/22; C10L 2270/026; C10L 2290/02
See application file for complete search history.

(56) References Cited

U.S. PATENT DOCUMENTS 2,393,594 A 1/1946 Davis
8,904,994 B2 12/2014 Michikawauchi et al.
2008/0098645 A1* 5/2008 Renninger ..... C12P 5/007 44/388
2011/0023351 A1 2/2011 Poirier et al.
2022/0056856 A1 2/2022 Heggen
2022/0275299 A1* 9/2022 Wibberley ..... C10L 8/00

OTHER PUBLICATIONS

Feb. 10, 2023 Search Report issued in French Patent Application No. 2206261.
Gray et al., "Ammonia Fuel-Engine Compatibility and Combustion", SAE 2010 Commercial Vehicle Engineering Congress SAE Technical Papers, vol. 660156, Feb. 1, 1966, pp. 1-18.
Gray et al., "Research Program on Additives for use in Ammonia Fuel for Internal Combustion Engines", CAE Report No. 1054, vol. II, May 1967.
Dai et al., "Ignition delay times of NH3 /Dme blends at high pressure and low DME fraction: RCM experiments and simulations", Combustion and Flame, vol. 227, May 2021, pp. 120-134.
Stein et al., "The Autoignition Behavior of Surrogate Diesel Fuel Mixtures and the Chemical Effects of 2-Ethylhexyl Nitrate (2-EHN) Cetane Improver," Society of Automotive Engineers, pp. 1029-1045, 1999.
Issayev et al., "Ignition delay time and laminar flame speed measurements of ammonia blended with dimethyl ether: A promising low carbon fuel blend," Renewable Energy 181 (2022), pp. 1353-1370.

* cited by examiner

*Primary Examiner* — Ellen M McAvoy
*Assistant Examiner* — Chantel Graham
(74) *Attorney, Agent, or Firm* — Oliff PLC

(57) ABSTRACT

The invention relates to a compression ignition engine fuel comprising 95.0% to 99.9% by weight ammonia and 0.01% to 5.0% by weight of an alkyl nitrate or mixture of alkyl nitrates.

18 Claims, 2 Drawing Sheets

AMMONIA-BASED FUEL FOR COMPRESSION ENGINES CONTAINING A COMBUSTION ENHANCEMENT ADDITIVE

FIELD OF THE INVENTION

The field of the invention is that of fuels for compression ignition engines, more particularly engines for marine applications. The fuel of the invention is part of the new fuels with reduced environmental impact, for example those commonly called "e-fuels" when they are made from low carbon electricity, low carbon footprint hydrogen and/or $CO_2$. They are considered as a solution for the decarbonisation of transport for heavy and long distance mobility. The fuel of the invention essentially composed of ammonia is thus part of the ecological alternatives for the replacement of diesel and heavy fuel oil. The invention relates to an additive which, when incorporated into the ammonia, ensures better ignition and faster combustion of the fuel in the engine.

STATE OF THE ART

Ammonia ($NH_3$) represents an alternative with a reduced impact on the environment and a credible renewable fuel to replace diesel and heavy fuel oil for maritime transport in the near future. The combustion of $NH_3$ generates only water and nitrogen and no emissions of carbon molecules ($CO_2$, CO) or soot particles. Ammonia is a compound whose manufacture is proven and common, which makes its uses, transport and storage known. It is also a product whose cost remains reasonable enough to be used as a fuel. Ammonia as a fuel has an energy density usable in compressive ignition engines but has a low cetane number. Its ignition in diesel engines remains problematic especially at low engine speeds. Ammonia is stored under pressure (~9 bars) in a liquid state in a tank and injected in a liquid or gaseous state into the engine.

Various means of improving the ignition of ammonia in a compression ignition engine have been described.

The first means is the co-injection of a pilot fuel with ammonia into the engine. The prior art, such as patent application US 2022/0056856, describes processes for co-injecting a so-called "pilot fuel", or oxygen and/or hydrogen with ammonia. This co-injection in a premixing chamber favors the ignition of the ammonia. This type of process has the major disadvantage of requiring control of the co-injection according to the engine's operating conditions, structural arrangements such as separate tanks and injection systems. Also, the use of a fuel oil as a pilot fuel generates undesirable $CO_2$ emissions and soot.

The second means is a mixture of fuels with ammonia. Fuels consisting of a mixture of essentially ammonia and dimethyl ether (DME) have been described in the prior art. DME is a synthetic fuel recommended as an alternative to diesel. These fuels are described in the article entitled "Ignition delay times of $NH_3$/DME blends at high pressure and low DME fraction: RCM experiments and simulations" (Combustion and Flame Volume 227, May 2021, Pages 120-134) and in the article entitled "Ignition delay time and laminar flame speed measurements of ammonia blended with dimethylether: A promising low carbon fuel blend" (Renewable Energy Volume 181, January 2022, Pages 1353-1370). These articles describe a fuel consisting of a mixture of essentially ammonia and dimethyl ether with better ignition delay than ammonia alone. The ammonia/DME fuel contains a DME fraction greater than 2%, ideally close to 18%. This high level of a hydrocarbon co-fuel in ammonia is therefore not in line with $CO_2$ emission reduction targets. On the other hand, DME is in a gaseous state at atmospheric pressure, which is a drawback for its storage and use.

The third means is the injection of an ignition enhancer into the engine chamber prior to the injection of ammonia. U.S. Pat. No. 8,904,994 describes, to improve the ignition of ammonia, the injection before the ammonia of a highly flammable compound that self-ignites at the time of ammonia injection. This compound can be a GTL or DME diesel fuel (as previously described), a cetane-modifying sulfate, a nitro compound of acetone, ethylene, hydrazine, acetylene, hydrazine being the preferred compound. These compounds all have obvious disadvantages as some are highly toxic and unstable and/or highly flammable or sulfurized.

On another level, in the field of hydrocarbon diesel or bio-diesel fuels, 2-ethylhexyl nitrate (EHN) has long been known to be used as a cetane enhancer additive in diesel fuel. A higher cetane value ensures lower fuel consumption, reduced particulate matter and NOx emissions, faster cold engine start-up, reduced engine knock and noise, and reduced engine wear. The reaction mechanism of EHN in the presence of a hydrocarbon diesel fuel has been studied for example in the scientific publication "The Autoignition Behavior of Surrogate Diesel Fuel Mixtures and the Chemical Effects of 2-Ethylhexyl Nitrate (2-EHN) Cetane Improver" (vol. 108, section 4: Journal of fuels and lubricants (1999), pp. 1029-1045). However, the reaction mechanism of its cetane-improving effect is still poorly understood and its use is based on empirical laws. For this reason, its effectiveness on fuels other than diesel cannot be assumed. This additive is industrially produced and widely used in commercial diesel fuels. More than fifty thousand tons of EHN have been produced per year in Europe since the 1980s. Other alkyl nitrates can also be used as cetane number enhancement additives in diesel fuel. FIG. 1 shows the similarity to EHN of the effects on the cetane number of different alkyl nitrates in addition to a standard diesel fuel (medium paraffinic (~40%) with a low natural cetane number but a standard cetane enhancement response). The cetane number enhancement effect is obtained for an alkyl nitrate incorporation in the diesel fuel close to 0.03% by weight.

The present disclosure provides a solution for improving the ignition of ammonia in standard engines by adding an alkyl nitrate, such as EHN, to the ammonia fuel. It is unexpected that additives known to increase the cetane number of a hydrocarbon can be so effectively used to improve the ignition of a carbonless fuel.

SUMMARY OF THE INVENTION

The present disclosure relates to a compression auto-ignition engine fuel comprising from about 95.0% to about 99.9% by weight of ammonia, and from about 0.01% to about 5.0% by weight of a compound which significantly improves the ignition delay of the ammonia.

Said compound is an alkyl nitrate or a mixture of alkyl nitrates.

Said compound has the advantage of being liquid at room temperature, low flammability, and industrially produced.

The said compound, at these low levels in the presence of the ammonia fuel, is therefore conventionally assimilated to a fuel additive.

The addition of the said liquid compound is carried out either by co-injection with ammonia in the liquid or gaseous state in an engine premix chamber, or preferably by mixing with the liquid ammonia prior to injection into the engine.

The said compound, of the alkyl nitrate type, previously reserved for improving the cetane number of hydrocarbon diesel fuels, is therefore used effectively and surprisingly as an additive for improving the ignition of ammonia.

DESCRIPTION OF THE INVENTION

Figure 1:
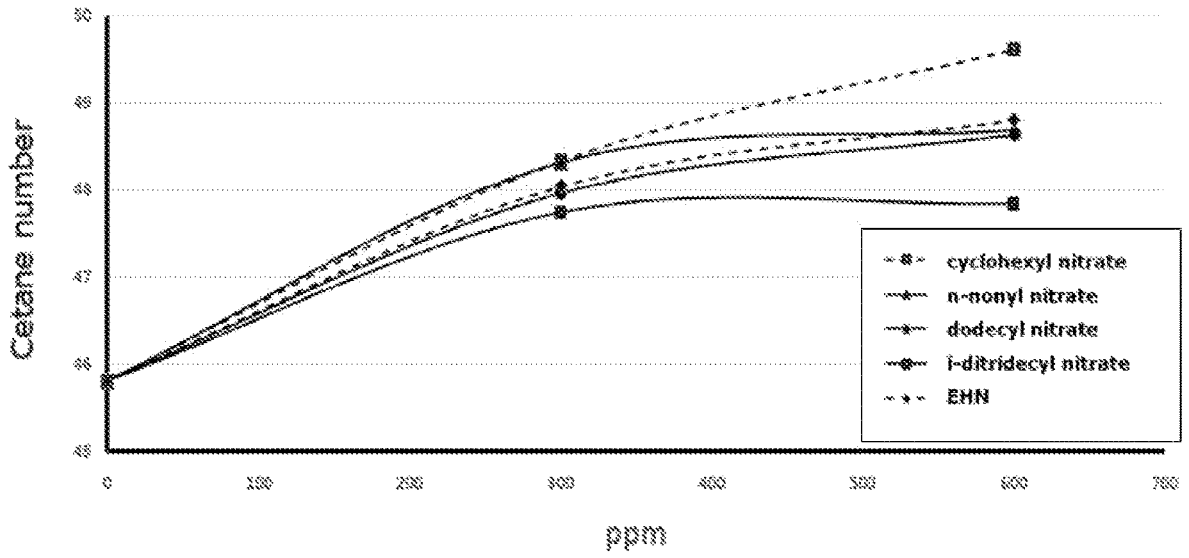
FIG. 1 shows the effect of alkyl nitrates on the cetane number of a standard diesel fuel.

The present disclosure relates to a compression ignition engine fuel which comprises about 95.0% to about 99.9% by weight ammonia and about 0.01% to about 5.0% by weight of a fuel ignition enhancement compound consisting of an alkyl nitrate or a mixture of alkyl nitrates. In one embodiment, the fuel comprises about 0.05% to about 2.0% by weight of said compound. In another embodiment, the fuel comprises about 0.1% to about 0.8% by weight of said compound.

In one embodiment, the fuel of the invention consists of ammonia and said compound (and in this case, the amount of compound in the fuel is at least 0.1% by weight).

In another embodiment, when the sum of the amount of ammonia and the amount of compound is not equal to 100% by weight, the fuel may contain one or more other additives to complete the fuel to 100%, such as additives with preservative, anti-corrosion or detergent functions.

Said compound added to the ammonia is selected from one or more linear, branched or cyclic alkyl nitrates.

Said compound is more particularly selected from linear alkyl nitrates having 4 to 36, advantageously 4 to 24 carbon atoms, branched alkyl nitrates having 4 to 36, advantageously 4 to 24 carbon atoms, cyclic alkyl nitrates (or cycloalkyl nitrates) having 5 to 18 carbon atoms, and mixtures thereof. In one embodiment, said compound is selected from 2-ethylhexyl nitrate, cyclohexyl nitrate, dodecyl nitrate, n-nonyl nitrate, 2-tetradecyl-1-octadecyl nitrate, hexyl nitrate, 2-octyl nitrate, isononyl nitrate, 2-propylheptyl nitrate, a mixture of $C_9$ to $C_{13}$ branched alky nitrates, and mixtures thereof. In one embodiment, the alkyl nitrate is 2-ethylhexyl nitrate alone or in admixture with one or more other alkyl nitrates as defined above, advantageously the alkyl nitrate is-2-ethylhexyl nitrate alone. Mixtures of $C_9$ to $C_{13}$ branched alkyl nitrates can be synthesized from the corresponding mixtures of branched $C_9$ to C13 alcohols, for example the alcohols available under the tradename Exxal™ from Exxon.

According to an embodiment, the compound consisting of an alkyl nitrate or a mixture of alkyl nitrates is mixed with liquefied ammonia (under pressure) in a tank which feeds an engine, to obtain the fuel according to the invention.

According to one embodiment, said compound and the liquefied ammonia are stored separately, and brought into the presence of each other in an injector, thus forming the fuel according to the invention, before it is fed into the combustion chamber of the engine.

According to one embodiment, said compound is stored separately from the ammonia and is co-injected with the liquefied or gaseous ammonia to form the fuel according to the invention in a premix chamber of the engine.

The present disclosure also relates to the use of an alkyl nitrate or a mixture of alkyl nitrates, in the proportions defined above, as an ignition enhancer for an ammonia-based fuel.

The invention is illustrated by the following illustrative examples.

EXAMPLES

The ignition delay improvement of liquid ammonia was measured under test conditions equivalent to those described in the scientific article "Ignition delay times of $NH_3$/DME blends at high pressure and low DME fraction: RCM experiments and simulations" (Combustion and Flame, Volume 227, May 2021, Pages 120-134). The test laboratory engine is a fast compression machine equivalent to the one described in this scientific article. It is a fast compression machine for measuring the auto-ignition time of a mixture.

This machine allows compressing in a very short time the mixture in order to obtain preset pressure and temperature conditions. The liquids are admitted into the tank through a different orifice than the gas inlet. The liquid quantities are measured with a syringe and a precision balance.

The ignition delay dAI is defined according to the following formula in which Pc is the pressure applied to the injected fuel:

$$dAI = t\left(\frac{dP}{dt}_{max}\right) - t(P_c)$$

Example 1

Figure 2:
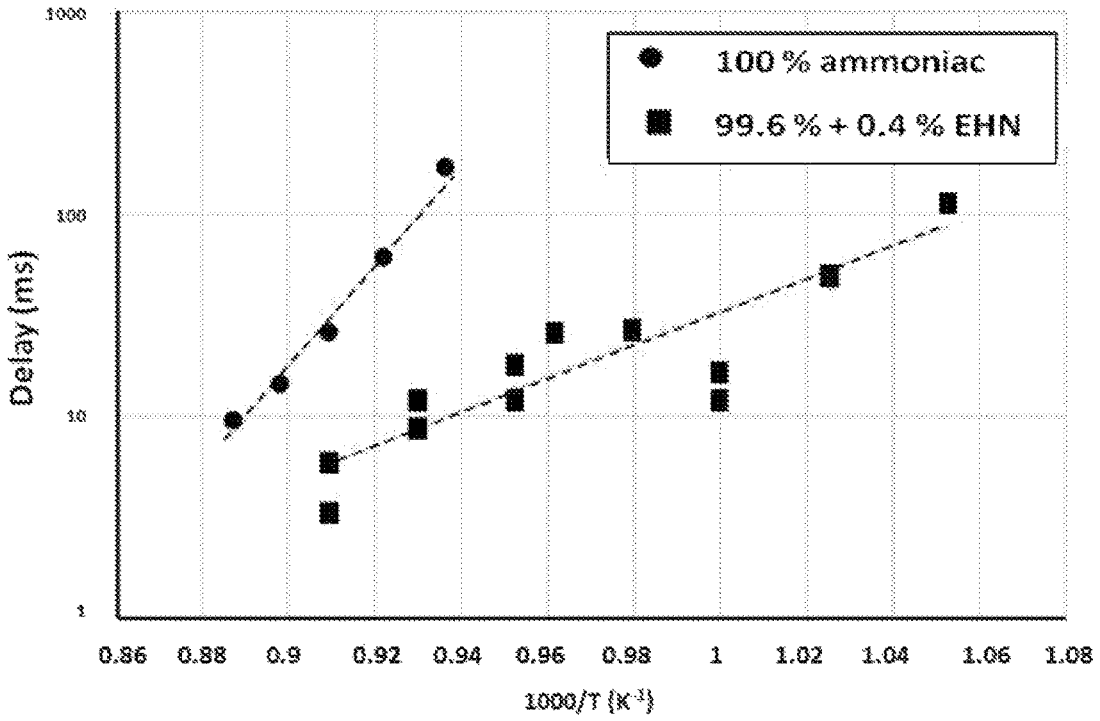
FIG. 2 shows the ignition delay of ammonia as a function of temperature, for a richness (air/fuel) of 1 at a compression pressure Pc of 40 bar; left curve=fuel consisting of 100/ammonia; right curve=fuel consisting of 99.6% ammonia and 0.4% EHN.

The ignition delay was determined as a function of the injection temperature (between 950K and 1100K) at a pressure Pc of 40 bar of a fuel consisting of 99.6% by weight ammonia and 0.4% by weight EHN and for a mixture richness of 1 with air. The given reference points of the ignition delay of ammonia alone (FIG. 2, left curve) are from the above mentioned article. A significant reduction of about a factor of 10 in fuel ignition delay compared to ammonia alone is observed in FIG. 2 (right curve). This reduction in ignition delay with the fuel of the invention compared to ammonia alone is greater the lower the temperature.

Example 2

Figure 3:
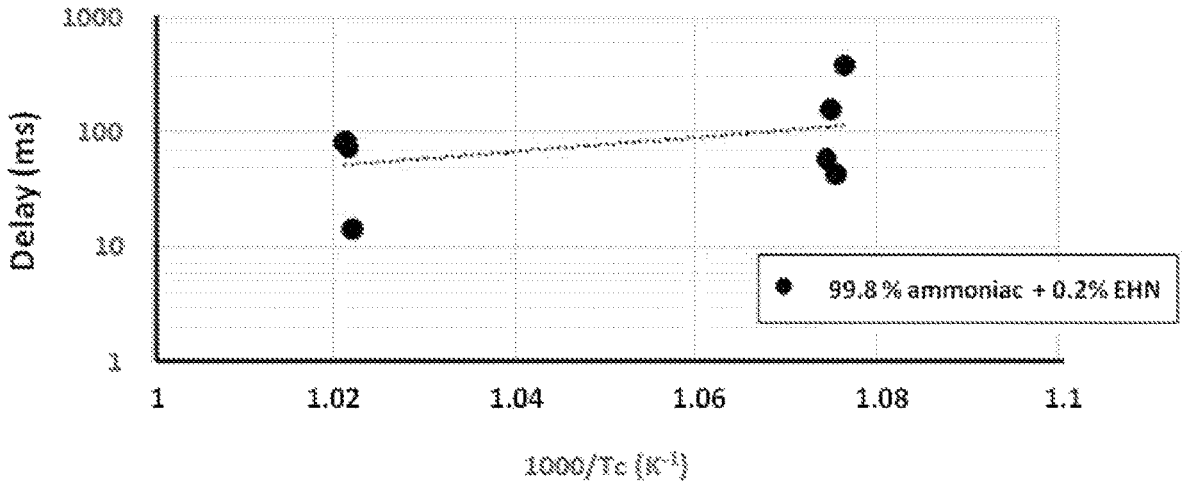
FIG. 3 shows the ignition delay of a fuel consisting of 99.8% ammonia and 0.2% EHN as a function of temperature, for a richness (air/fuel) of 1.5 at a compression pressure Pc of 30 bar.

The ignition delay of a fuel consisting of 99.8% by weight of ammonia and 0.2% by weight of EHN was determined as a function of the injection temperature (between 925K and 1000K) at a pressure Pc of 30 bars and for a mixture richness of 1.5 with air. The ignition delays of the fuel are less than 800 ms (FIG. 3) whereas under these test conditions ammonia alone does not ignite.

Example 3

Figure 4:
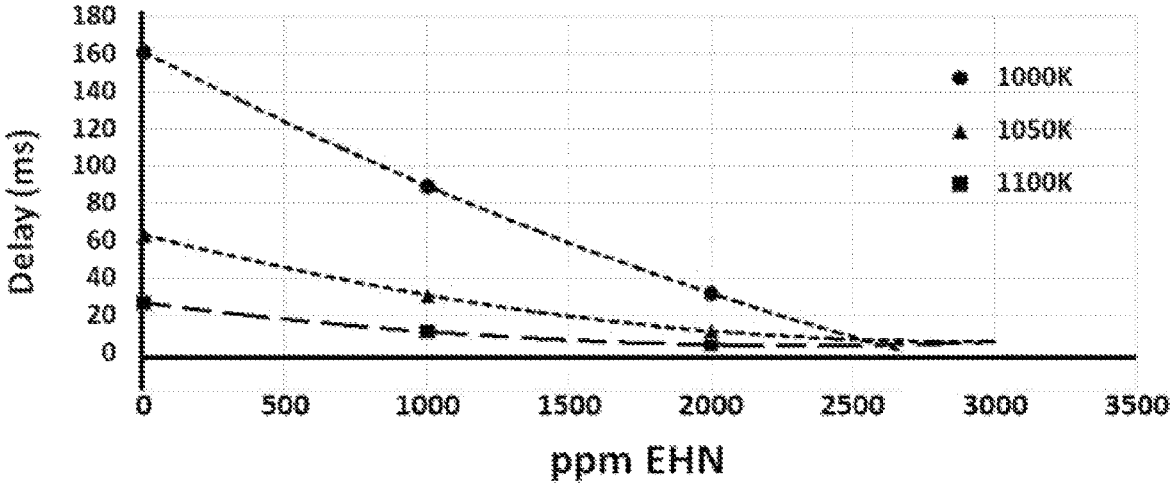
FIG. 4 shows the ignition delay of an ammonia-based fuel containing different amounts of EHN, for a richness (air/fuel) of 0.35, at a compression pressure Pc of 43.4 bar, over a temperature range from 1000K to 1100K.

The ignition delay of a fuel consisting of either ammonia alone, or 99.9% by weight ammonia and 0.1% by weight EHN, or 98.0% by weight ammonia and 2.0% by weight EHN, was determined at 3 temperatures (1000K, 1050K and 1100K), at a pressure Pc of 43.4 bar, for a mixture richness of 0.35 with air. For all three temperatures, the ignition delays of the fuels are lower than those of ammonia alone (FIG. 4). The effectiveness of EHN addition on ignition delay compared to ammonia alone (as already observed in Example 1) is greater the lower the temperature. An optimum weight ratio of 0.25% EHN is substantially achieved by extrapolating the curves under these three temperature conditions.

These examples show that the use of alkyl nitrate(s) in very low weight percentage can significantly improve the ignition delay of an ammonia-based fuel. There was no reason to believe that additives known to increase the cetane number of a diesel or biodiesel hydrocarbon could be used so effectively, in very small quantities, to improve the ignition of ammonia.

Although the presently disclosed subject matter and its advantages have been described in detail, it should be understood that various changes, substitutions and alterations can be made herein without departing from the spirit and scope of the application as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the presently disclosed subject matter, processes, machines, manufacture, compositions of matter, means, methods, or steps, presently existing or later to be developed that perform substantially the same function or achieve substantially the same result as the corresponding embodiments described herein can be utilized according to the presently disclosed subject matter. Accordingly, the appended claims are intended to include within their scope such processes, machines, manufacture, compositions of matter, means, methods, or steps.

In addition to the various embodiments depicted and claimed, the disclosed subject matter is also directed to other embodiments having any other possible combination of the features disclosed and claimed herein. As such, the particular features presented herein can be combined with each other in other manners within the scope of the disclosed subject matter such that the disclosed subject matter includes any suitable combination of the features disclosed herein. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the device, method, and system of the disclosed subject matter without departing from the spirit or scope of the disclosed subject matter. Thus, it is intended that the disclosed subject matter include modifications and variations that are within the scope of the appended claims and their equivalents.

For any patents, patent applications, publications, product descriptions, and protocols are cited throughout this application, the disclosures of all of which are incorporated herein by reference in their entireties for all purposes.

We claim:

1. A compression ignition engine fuel comprising 95.0% to 99.9% by weight ammonia and 0.01% to 5.0% by weight of an alkyl nitrate, wherein said alkyl nitrate is selected from the group consisting of 2-ethylhexyl nitrate, cyclohexyl nitrate, dodecyl nitrate, n-nonyl nitrate, 2-tetradecyl-1-octadecyl nitrate, hexyl nitrate, 2-octyl nitrate, isononyl nitrate, 2-propylheptyl nitrate, a mixture of $C_9$ to $C_{13}$ branched alkyl nitrates, and mixtures thereof.

2. The fuel of claim 1, comprising 0.05% to 2.0% by weight of said alkyl nitrate.

3. The fuel of claim 1, comprising 0.1% to 0.8% by weight of said alkyl nitrate or a mixture of alkyl nitrates.

4. The fuel of claim 1, which consists of 95.0% to 99.9% by weight of said ammonia and 0.01% to 5.0% by weight of said alkyl nitrate.

5. The fuel of claim 1, wherein the alkyl nitrate is 2-ethylhexyl nitrate.

6. A method of obtaining a fuel as defined in claim 1, which comprises mixing the alkyl nitrate and liquefied or gaseous ammonia.

7. The method of claim 6, wherein the liquefied ammonia and the alkyl nitrate are mixed in an engine tank.

8. The method of claim 6, wherein the liquefied ammonia and the alkyl nitrate are mixed in an injector.

9. The method of claim 6, wherein the liquefied or gaseous ammonia and the alkyl nitrate are mixed in a premix chamber of an engine.

10. A method of reducing the ignition delay of an ammonia-based fuel, which comprises adding from 0.01% to 5.0% by weight of an alkyl nitrate to said ammonia-based fuel.

11. The method of claim 10, comprising adding from 0.05% to 2.0% by weight of alkyl nitrate to the ammonia-based fuel.

12. The method of claim 10, comprising adding from 0.1% to 0.8% by weight of alkyl nitrate to the ammonia-based fuel.

13. The method of claim 10, wherein the alkyl nitrate is a linear alkyl nitrate having from 4 to 36 carbon atoms, a branched alkyl nitrate having from 4 to 36 carbon atoms, a cyclic alkyl nitrate having from 5 to 18 carbon atoms, or a mixture of these nitrates.

14. The method of claim 10, wherein the alkyl nitrate is selected from the group consisting of 2-ethylhexyl nitrate, cyclohexyl nitrate, dodecyl nitrate, n-nonyl nitrate, 2-tetradecyl-1-octadecyl nitrate, hexyl nitrate, 2-octyl nitrate, isononyl nitrate, 2-propylheptyl nitrate, mixtures of $C_9$ to $C_{13}$ branched alkyl nitrates, and mixtures thereof.

15. The method of claim 10, wherein the alkyl nitrate is 2-ethylhexyl nitrate.

16. The method of claim 10, wherein a fuel formulation resulting from said method consists of ammonia and the alkyl nitrate.

17. The fuel of claim 1, consisting essentially of said ammonia and said alkyl nitrate.

18. The method of claim 10, wherein a fuel formulation resulting from said method consists essentially of ammonia and said alkyl nitrate.

* * * * *